United States Patent [19]

Nicholas et al.

[11] 4,020,027

[45] Apr. 26, 1977

[54] FOUNDRY MOULDING MATERIALS

[75] Inventors: Kenneth Ernest Lewis Nicholas, Birmingham; John Glyn Morley, Alcester, both of England

[73] Assignee: The British Cast Iron Research Association, Birmingham, England

[22] Filed: June 14, 1976

[21] Appl. No.: 695,466

[52] U.S. Cl. ..... 260/17.2; 106/38.5 R

[51] Int. Cl.[2] ..... C08L 3/02

[58] Field of Search ..... 260/17.2

[56] References Cited

UNITED STATES PATENTS

| | | | |
|---|---|---|---|
| 1,857,690 | 5/1932 | Mellanoff | 260/17.2 |
| 1,959,433 | 5/1934 | Loetscher | 260/17.2 |
| 2,926,098 | 2/1960 | Ilenda et al. | 106/38.5 |
| 3,360,492 | 12/1967 | Tsou | 260/17.3 |

*Primary Examiner*—Edward M. Woodberry

*Attorney, Agent, or Firm*—Scrivener, Parker, Scrivener and Clarke

[57] ABSTRACT

A composition for making foundry moulds and cores of improved strength comprises a mixture of a granular refractory material, a sodium silicate binder and a polymeric resin material. The polymeric resin material is formed by heating together phenol, a carbohydrate and formaldehyde in the presence of a catalyst.

14 Claims, No Drawings

FOUNDRY MOULDING MATERIALS

The use of sodium silicate as a binder for foundry moulds and cores is well known. Processes in common use include the injection of carbon dioxide gas into moulds and cores made from mixtures of sand and sodium silicate to achieve hardening, or the inclusion of materials such as dicalcium silicate, Portland cement, ferrosilicon, calcium silicide, silicon and various organic esters as hardening agents for sodium silicate in self-setting mixtures made from these materials, sodium silicate and sand.

Compared with many of the resin binders used in the foundry industry in alternative mould and core making processes the strengths obtained with sodium silicate binders are relatively low and are liable to change and deteriorate if the moulds and cores are not used within a short time after manufacture. The eventual separation of the moulds and cores from castings, and disintegration at the knock-out stage are usually more difficult and tedious when using sodium silicate binders instead of resin binders to manufacture moulds and cores. It is common practice to add materials to sand mixtures bonded with sodium silicate to improve the disintegration of the moulds and cores at the knock-out stage. Materials frequently used as additives for this purpose include sugars, starches, coal dust, pitch, petroleum bitumen, asphalts, iron oxide, clays, ground limestone, chalk and dolomite. However, many of these materials adversely affect the strength properties of moulds and cores made from sands bonded with sodium silicate and accelerate the rate of deterioration when such moulds and cores are stored in a foundry for later use.

Various suggestions have been made as to methods of improving the strength of moulds and cores made from sodium silicate bonded sands and at the same time preventing deterioration of moulds and cores not required for immediate use. For example, Petrzela and Gajdusek (Modern Castings 1962, v.41, February, pp. 67–87) have claimed that moulds and cores can be strengthened by spraying their surfaces with coatings consisting of sulphite lye, dextrin, artificial resin or sodium silicate solutions, while Ziegler and Hammer (Giesserei-Nachrichten, 1958, v.5, May, pp. 15–19) have reported that good abrasion resistant surfaces could be obtained by the use of washes containing collodion or potato flour. A different approach was adopted by von Pilinszky (Giesserei, 1965, v.52, February 4, pp. 67–70) who added synthetic resins, preferably phenol formaldehyde resins, directly to sand and sodium silicate mixtures.

A proposal has also been made to add sugar to a binder comprising sodium silicate and a phenol resin. However in this prior proposal the sugar was merely added to the existing phenol formaldehyde compound without reaction.

The aim of the present invention is to ensure a consistent and repeatable improvement in the strength of a silicate-bonded core or mould, together with, if possible improved ease of knocking-out.

According to the invention it is proposed to add to a grannular refractory material in addition to a sodium silicate binder a polymeric resin material produced by heating together phenol, a carbohydrate and formaldehyde in the presence of a catalyst. For the purpose of this specification the term "phenol" means phenol or a phenolic mixture containing a major proportion of phenol. For the sake of convenience the polymeric resin material is referred to as a sugar-phenol-formaldehyde resin throughout this specification.

As will be clear from the comparative tests below, the addition of the resin to the refractory mixture results not only in an improved strength immediately on hardening but also a strength which is maintained, and even increased, on prolonged storage. Yet at the same time the ease with which cores made of the improved material can be knocked out is considerably increased.

The quantity of sodium silicate in the composition follows the usual rules, and the silicate can be hardened in the known ways, either by gassing with carbon dioxide or by the incorporation of a hardener in the refractory composition, making it self-hardening.

The quantity of phenol-carbohydrate-formaldehyde resin in the composition is preferably in the range of from 6% to 60%, by weight, of the quantity of sodium silicate, and is preferably about 20% by weight. For example, where 3.5% by weight of sodium silicate is present, the resin may be 0.75% by weight.

The carbohydrate is preferably a sugar or a water soluble starch derivative, for example sucrose, dextrose or dextrin. When sucrose or dextrose or other low molecular weight carbohydrates are used the molecular proportions may vary within the range 1.5 to 4.5 parts of phenol, 0.25 to 3 parts of the carbohydrate and 6 to 12 parts of formaldehyde. A preferred composition, where the carbohydrate is sucrose, is 3.5 parts of phenol, one part of sugar and 9 parts of formaldehyde. When carbohydrates such as dextrin are used which have high but indefinite molecular weights, the total carbohydrate content of the resin product may be between 5% and 40% by weight, the molecular proportions of phenol an formaldehyde remaining in the ranges 1.5 to 4.5 parts and 6 to 12 parts respectively.

The three comonents of the resin are mixed together and then heated in the presence of the catalyst, for example from 4% to 9% by weight of sodium hydroxide.

Typically the resulting resin product should contain from 20% to 60% of water by weight.

Preferably, the resulting polymer is such as not to cause significant premature gelling of the sodium silicate. Preferably, when one part by weight of the resin is mixed with four parts by weight of the sodium silicate solution which is to be used no more than a trace of silica gel results.

Impure sugars may be used: in fact a wide range of polysaccharides and other carbohydrates.

When this resin is used in mixtures bonded with sodium silicate for the production of foundry moulds and cores hardened by the passage of carbon dioxide gas the strength of the core immediately after gassing, hereinafter referred to as the as-gassed core, improves substantially and if these same moulds and cores are then stored for later use very high strengths are developed without further treatment. A further benefit is that high strengths are maintained in stored moulds and cores despite long initial gassing with carbon dioxide; whereas in the absence of the resin strength deteriorates seriously after subjecting moulds and cores to similar long periods of gassing. Examples of the improvements obtained by adding 0.75 percent by weight of a sugar-pheonol-formaldehyde resin to mixtures bonded with 3.5 percent by weight of a 2.5 : 1 $SiO_2$ : $Na_2O$ molar ratio (S.G. 1.50) sodium silicate are shown in Table 1. For comparison purposes this Table contains data on a mixture bonded with 3.5 percent by weight of the 2.5 : 1 $SiO_2$ : $Na_2O$ molar ratio sodium silicate without an addition of resin and results for Binders 1 and 6 made from the same sodium silicate with two different phenol resol resins and with separate additions of sugar.

TABLE 1

Compression Strengths of mixtures hardened with Carbon Dioxide Gas

| Time (Hours) | $CO_2$ Gassing Time(s) | Compression Strength lb/in² 2.5:1 molar ratio Sodium Silicate no resin addition | 2.5:1 molar ratio Sodium Silicate + sugar-phenol formaldehyde resin | Binders prepared with different phenol resins and with separate additions of sugar: Binder 1 | Binder 6 |
|---|---|---|---|---|---|
| Immediate as-gassed | 18 | 124 | 249 | 126 | 201 |
| | 36 | 192 | 297 | 193 | 257 |
| | 60 | 238 | 284 | 195 | 259 |
| 24 hours after gassing | 18 | 526 | 704 | 360 | 528 |
| | 36 | 247 | 758 | 153 | 538 |
| | 60 | 269 | 613 | 116 | 453 |
| 48 hours after gassing | 18 | 834 | 885 | 333 | 890 |
| | 36 | 455 | 768 | 127 | 567 |
| | 60 | 334 | 840 | 115 | 488 |

The sugar-phenol-formaldehyde resin can be used in combination with other compositions of sodium silicate, e.g. 2 : 1 $SiO_2$ : $Na_2O$ molar ratio S.G.1.56, and produces large increases in the as-gassed strength and the strength of moulds and cores stored for future use after hardening with carbon dioxide gas. An example of the benefit obtained with a 2:1 ratio silicate is shown in the following Table 2.

Table 2

Compression strengths (lb/in²) of 2" × 2" cylindrical cores containing 3.5 percent by weight, 2:1 ratio sodium silicate with, and without, an addition of 0.75 percent by weight sugar-phenol-formaldehyde resin.

| Gassing and Storage times | | No resin addition | 0.75 percent by weight resin addition |
|---|---|---|---|
| As-gassed | 30s | 49 lb/in² | 159 |
| | 60s | 140 | 224 |
| | 90s | 205 | 269 |
| 24 hour | 30s | 910 | 917 |
| | 60s | 363 | 697 |
| | 90s | 422 | 590 |
| 48 hour | 30s | 790 | 1065 |
| | 60s | 633 | 1020 |
| | 90s | 447 | 678 |

The sugar-phenol-formaldehyde resin can also be used with very high ratio silicates e.g. 3.0 : 1 molar ratio $SiO_2$ : $Na_2O$ to accelerate the rate of strength development during gassing with carbon dioxide and to improve the properties of the resultant hardened mould or core substantially:

| Gassing Times | 5 percent by weight 3.0 : 1 molar ratio sodium silicate | 5 percent by weight 3.0 : 1 molar ratio sodium silicate plus 0.75 percent by weight sugar-phenol-formaldehyde resin |
|---|---|---|
| 6s | 68 lb/in² | 155 lb/in² |
| 12s | 153 | 197 |
| 18s | 178 | 236 |

In addition to increasing the bond strength of moulds and cores the presence of the sugar-phenol-formaldehyde resin improves the casting knock-out and facilitates the disintegration of moulds and cores bonded with sodium silicate. The improved disintegration of moulds and cores at knock-out is shown by the results in Table 3 which apply to cores containing 2.0 : 1, 2.5 : 1 and 3.0 : 1 molar ratio $SiO_2$ : $Na_2O$ ratio silicates and made with and without an addition of 0.75 percent by weight sugar-phenol-formaldehyde resin. The results in this Table apply to 2 × 2 inches cylindrical cores in 25 Kg grey iron castings poured at 1400° C. The measurements were made by driving a Ridsdale-BCIRA impact probe through the axes of the cores retained in the cold castings and counting the number of impact strokes of the spring loaded probe necessary to penetrate successive 1 cm distances through each core. The smaller the number of impacts required the easier cores disintgerated.

Table 3

Impact Resistance of Cores at Knock-Out

| Core Mixture | Average No. of impacts per cm penetration |
|---|---|
| 3.5 percent by weight 2.0 : 1 molar ratio silicate | 16.6 |
| 3.5 percent by weight 2.0 : 1 molar ratio silicate + 0.75% by weight sugar phenol formaldehyde resin | 5.1 |
| 3.5 percent by weight 2.5 : 1 molar ratio silicate | 10.4 |
| 3.5 percent by weight 2.5 : 1 molar ratio silicate + 0.75% by weight sugar phenol formaldehyde resin | 2.6 |
| 3.5 percent by weight 3.0 : 1 molar ratio silicate | 5.0 |
| 3.5 percent by weight 3.0 : 1 molar ratio silicate + 0.75% by weight sugar phenol formaldehyde resin | 1.0 |

The following Table 4 shows the results obtained using dextrose and dextrin respectively in the compound in place of sucrose, the layout being similar to Table 2.

Table 4

| | | 0.75% by weight Dextrose 3.5% by weight Sodium Silicate | 0.75% by weight Dextrin 3.5% by weight Sodium Silicate |
|---|---|---|---|
| Immediately after gassing (As gassed) | 18s | 236 lb/in² | 204 lb/in² |
| | 36 | 260 | 242 |
| | 60 | 253 | 244 |

Table 4-continued

| | | 0.75% by weight Dextrose 3.5% by weight Sodium Silicate | 0.75% by weight Dextrin 3.5% by weight Sodium Silicate |
|---|---|---|---|
| 24 hour after gassing | 18s | 731 | 703 |
| | 36 | 624 | 520 |
| | 60 | 411 | 712 |
| 48 hour after gassing | 18s | 630 | — |
| | 36 | 586 | — |
| | 60 | 458 | — |
| 120 hour after gassing | 18s | — | 875 |
| | 36 | — | 765 |
| | 60 | — | 568 |

Although in the examples quoted the proportion of sodium silicate added to the sand is 3.5% by weight and the proportion of the resin is 0.75% by weight (i.e. about 20% by weight of the amount of sodium silicate) we could use as little as 0.25% by weight of resin, (i.e. about 6% by weight of the quantity of sodium silicate) which would still give some improvement, or as much as 2% by weight (i.e. about 60% by weight of the quantity of sodium silicate), although the added improvement when the proportion of resin is greater than 1% is only small.

The following Table 5 shows the results obtained with additions of 0.25% by weight resin and 2% by weight sugar-phenol-formaldehyde resin respectively.

Table 5

| | | 0.25% by weight Resin 3.5% by weight 2.5 : 1 molar ratio Silicate | 2.0% by weight Resin 3.5% by weight 2.5 : 1 molar ratio Silicate |
|---|---|---|---|
| As-gassed | 18s | 171 lb/in² | 163 lb/in² |
| | 36 | 245 | 179 |
| | 60 | 236 | 176 |
| 24 hour | 18s | 712 | 770 |
| | 36 | 498 | 732 |
| | 60 | 303 | 676 |
| 48 hour | 18s | 788 | 739 |
| | 36 | 510 | 905 |
| | 60 | 352 | 626 |

We have also discovered that the hardening of self-setting mixtures bonded with sodium silicate is accelerated by the presence of the sugar-pheonol-formaldehyde resin in a sand mixture. Self-setting mixtures, which require no treatment with carbon dioxide gas, can be made by adding various organic esters (such as the Ashland Chemical Limited 'Chem Rez 3000' series) (Chem Rez is a Registered Trade Mark) to sand bonded with sodium silicate. These mixtures self-harden at room temperature and the compression strengths of cores made with and without an addition of 0.75 percent by weight resin to the mixture are compared in Table 6. The mixtures were bonded with 3.5 percent by weight of a 2.5 : 1 $SiO_2$ molar ratio sodium silicate and contained 0.35 percent by weight Ashland Chem Rez 3300 hardener. Organic esters that can be used in self-hardening mixtures include glycerol diacetate, glycerol triacetate, glycerol monoacetate, ethylene glycol diacetate, diethylene glycol diacetate or mixtures of these materials.

Table 6

Compression strengths (lb/in²) of self-hardening mixtures

| Time (Hours) after making cores | Mixture with addition 0.75% by weight sugar-phenol-formaldehyde resin | No resin addition |
|---|---|---|
| ¾ | 184 | 64 |
| 1½ | 304 | 124 |
| 2 | 337 | 147 |
| 2½ | 364 | 214 |

We claim:

1. A composition for making foundry moulds and cores comprising a granular refractory material, a sodium silicate binder, and in addition a polymeric resin reaction product resulting from the heating of a mixture of phenol, a carbohydrate and formaldehyde in the presence of a catalyst.

2. A composition as claimed in claim 1 wherein said resin product is present to the extent of from 6% to 60% by weight of said sodium silicate.

3. A composition as claimed in claim 2 wherein said resin product is present to the extent of substantially 20% by weight of said sodium silicate.

4. A composition as claimed in claim 1 wherein said carbohydrate in said resin is a sugar.

5. A composition as claimed in claim 4 wherein said carbohydrate is sucrose.

6. A composition as claimed in claim 1 wherein said carbohydrate in said resin is a water soluble starch derivative.

7. A composition as claimed in claim 6 wherein said carbohydrate is dextrose.

8. A composition as claimed in claim 6 wherein said carbohydrate is dextrin.

9. A composition as claimed in claim 8 wherein the components of said polymeric resin material are in the following proportions:

Molecular proportion of phenol: 1.5 to 4.5
Molecular proportion of formaldehyde: 6 to 12
Weight percentage carbohydrate: 5 to 40 percent.

10. A composition as claimed in claim 6 wherein the components of said polymeric resin material are in the following molecular proportions:

phenol: 1.5 to 4.5
carbohydrate: 0.25 to 3
formaldehyde: 6 to 12

11. A composition as claimed in claim 10 wherein the components of said polymeric resin material are in the following molecular proportions:

phenol: 3.5
carbohydrate: 1
formaldehyde: 9

12. A composition as claimed in claim 7 wherein the components of said polymeric resin material are in the following molecular proportions:

phenol: 1.5 to 4.5
carbohydrate: 0.25 to 3
formaldehyde: 6 to 12

13. A composition as claimed in claim 1 wherein said catalyst is sodium hydroxide.

14. A composition as claimed in claim 13 wherein said sodium hydroxide is present to the extent of between 4% and 9% by weight of the mixture of components that make up said resin.

* * * * *